US005505062A

United States Patent [19]

Okuno

[11] Patent Number: 5,505,062

[45] Date of Patent: Apr. 9, 1996

[54] METHOD FOR INCREASING STITCHES AT AN INTERMEDIATE POSITION IN A ROW OF STITCHES OF A RIB KNIT FABRIC

[75] Inventor: Masao Okuno, Wakayama, Japan

[73] Assignee: Shima Seiki Mfg., Ltd., Wakayama, Japan

[21] Appl. No.: 289,229

[22] Filed: Aug. 12, 1994

[30] Foreign Application Priority Data

Aug. 12, 1993 [JP] Japan ..... 5-200615

[51] Int. Cl.[6] ..... D04B 1/24

[52] U.S. Cl. ..... 66/70; 66/189

[58] Field of Search ..... 66/69, 70, 170, 66/171, 189, 198, 199

[56] References Cited

U.S. PATENT DOCUMENTS 2,616,275 11/1952 Bennington ..... 66/70

5,305,619 4/1994 Shima et al. ..... 66/70

FOREIGN PATENT DOCUMENTS 138660 7/1900 Germany ..... 66/70

*Primary Examiner*—John J. Calvert

*Attorney, Agent, or Firm*—Armstrong, Westerman, Hattori, McLeland & Naughton

[57] ABSTRACT

A method for increasing stitches at intermediate positions in a row of stitches of a rib knit fabric comprising the steps of: leaving a set of two target knitting needles on the front and rear beds, respectively, unoccupied, where increased stitches are to be formed, by shifting a predetermined number of loops from the knitting needles including the target needles in either leftward or rightward direction; forming stitches on knitting needles from one end of a knitting area to before the two target knitting needles; hooking a thread of yarn on first one of the unoccupied target knitting needles located next to the knitting needle to which the thread has been supplied at the end of the preceding course; hooking the thread on the other unoccupied target knitting needles; and, moving a carriage in a reverse direction and applying the thread again to the first target knitting needle to form an increased stitch.

8 Claims, 8 Drawing Sheets

METHOD FOR INCREASING STITCHES AT AN INTERMEDIATE POSITION IN A ROW OF STITCHES OF A RIB KNIT FABRIC

BACKGROUND OF THE INVENTION

The present invention relates to a method for increasing the number of stitches of a rib knit fabric using knitting needles of front and rear needle beds on flat knitting machine.

In knitting a fabric with a flat knitting machine, it is known to increase the stitches for shaping a knitted fabric with addition of wales.

For increasing the stitches, there are two major methods: one for making an increased stitch on an unoccupied knitting needle located outside the end of a row of stitches to extend the length of the row and the other for shifting a predetermined number of stitches of a row including a stitch at the end of a row in an outside direction to make unoccupied knitting needles, intermediate of the knitted row and forming loops on the unoccupied knitting needles.

In the former method, the edge of a knitted fabric is added with a new wale upon increasing stitches and will hardly be arranged neatly. The latter method produces additional wales in the middle of a knitted fabric, thus leaving the selvages at both edges intact.

Apparently, the latter method is advantageous over the former method in appearance and efficiency for joining a plurality of knitted fabrics to each other and is now widely used for fabricating common garments.

With the use of such a two-needle-bed type flat knitting machine in the present invention, stitches can be increased on both the front and rear needle beds simultaneously and equally.

A conventional method will be explained referring to a rib knitting shown in FIG. 10.

After repeating, a desired number of times, a couple of courses, as shown in FIG. 10-1 and 10-2, rows of stitches are completed forming a size of rib fabric. Then, the loop on the knitting needle B at the end of the last row of the rib knit fabric is transferred to a knitting needle a next to the opposite knitting needle b of the rear needle bed. After the rear bed is racked to the direction of the knitting needle a (to the left in the drawings), the loop is moved from the knitting needle a to a knitting needle A of the front bed. As the result, the loop is shifted from the needle B to the needle A in the leftward direction and the needle B becomes unoccupied.

By repeating this procedure on each loop with a series of racking actions, a desired number of loops of the row are shifted to the left so that as shown in FIG. 10-3, the two opposite knitting needles F and f hold no thread of yarn as shown in FIG. 10-3.

In the next step shown in FIG. 10-4, the thread is passed along the front knitting needles A to P, and the rear knitting needles a to p alternately, as a carriage of the flat knitting machine travels forward.

Accordingly, all the knitting needles, except F and f, hold knit stitches. Because of no thread supplied to needles F and f in the preceding course, the two knitting needles F and f have the thread not looped but just hooked.

Similarly, the loops on the knitting needles L to P and 1 to p of the front and rear beds, respectively, are shifted to the rightward direction with a series of racking actions in order to make increased stitches on the two knitting needles L and 1. As the result, the knitting needles L and 1 hold no threads as shown in FIG. 10-5.

In the succeeding step shown in FIG. 10-6, the thread is passed along the front knitting needles A to Q and the rear knitting needles a to q alternately throughout the width of a knitted fabric.

According to the conventional method, the thread is supplied to the unoccupied knitting needles F and f as the carriage travels in the forward direction.

Since no stitches are formed on the knitting needles F and f in the preceeding course, the thread 2 extending from the front knitting needle F to the rear knitting needle f remains not engaged with the thread 1 supplied in the preceding course, unlike the thread to any of the other knitting needles.

It will thus be likely that stitches formed on the knitting needles F and f in the succeeding course is pulled up by stitches formed in the further course.

As the result, a gap or hole appears where the increased stitches are formed thus deteriorating the quality of a finished knitted product.

SUMMARY OF THE INVENTION

For eliminating the foregoing drawback, an object of the present invention is to provide a method for increasing stitches at intermediate positions in a row of stitches of a rib knit fabric using a flat knitting machine which has at least a pair of front and rear needle beds, either or both of the needle beds being movable to left and right.

More particularly, the method includes making unoccupied a set of two target knitting needles on the front and rear beds, respectively, where increased stitches are formed by shifting a predetermined number of loops from the knitting needles, including the target needles in either leftward or rightward direction, and is characterized in that steps for forming increased stitches comprises steps of: forming stitches on knitting needles from one end of a knitting area to before the two target knitting needles; hooking a thread of yarn on first one of the unoccupied target knitting needles located next to the knitting needle to which the thread has been supplied at the end of the preceding course; hooking the thread on the other unoccupied target knitting needle; and moving a carriage in a reverse direction and applying the thread again to the first target knitting needle to form an increased stitch.

The increased stitch forming step may comprise: forming stitches from one end of a knitting area to before one of the two target knitting needles that is located at the further side in the forward direction of the carriage; hooking a thread of yarn on the further side unoccupied target knitting needle located next to the knitting needle to which the thread has been supplied at the end of the preceding course; moving the carriage in a reverse direction and locating the feeder of the thread to before the other unoccupied target knitting needle for preparation of a succeeding course; moving the carriage in the forward direction and hooking the thread on the other target knitting needle; and forming a knit stitch on the further side target knitting needle on which the thread has first been hooked.

The increased stitch forming step may comprise: forming stitches from one end of a knitted fabric to before one of the two target knitting needles that is located at the nearer side in the forward direction of the carriage; hooking a thread of yarn on the nearer side unoccupied target knitting needle located next to the knitting needle to which the thread has been applied at the end of the preceding course; hooking the thread on the other target knitting needle that is located at the further side in the carriage forward direction; moving the carriage in a reverse direction and forming a stitch on the nearer side target knitting needle on which the thread has first been hooked by; and moving the carriage in the forward direction.

The increased stitch forming step may comprise: forming stitches from one end of a knitting area to before one of the two target knitting needles that is located at the further side in the forward direction of the carriage; hooking a thread of yarn on the further side unoccupied target knitting needle located next to the knitting needle to which the thread has been supplied at the end of the preceding course; moving the carriage in a reverse direction and hooking the thread on the other unoccupied target knitting needle; moving the carriage in the forward direction and making a knit stitch on the further side target knitting needle on which the thread has first been hooked.

The method is applicable for increasing stitches at both the left and right selvages to widen the knitted fabric.

The knitted fabric fabricated by the stitch increase method of the present invention allows a row of stitches including increased stitches to be equal in number to the next row of stitches and hardly be pulled by stitches produced in the succeeding course.

The length of yarn will be short between an increased stitch and a stitch of the adjacent wale.

The increased stitch incorporates a knit stitch thus producing no hole or gap in the increased region.

At the increased stitches, the threads are intersected by each other thus keeping the increased stitches close to stitches in the adjacent wale.

BRIEF DESCRIPTION OF THE DRAWINGS

FIG. 3 is a schematic view showing a pattern of yarn of increased stitches of the first embodiment;

FIGS. 4-1 through 4-6 and FIGS. 5-1 through 5-4 illustrate a sequence of knitting courses according to a second embodiment of the present invention;

FIG. 6 is a schematic view showing a pattern of yarn of increased stitches of the second embodiment;

FIGS. 7-1 through 7-6 and FIGS. 8-1 through 8-4 illustrate a sequence of knitting courses according to a third embodiment of the present invention;

FIGS. 10-1 through 10-6 illustrate a sequence of increasing stitches in a rib knitted fabric according to a conventional method.

DETAILED DESCRIPTION OF THE PREFERRED EMBODIMENTS

The method for knitting a rib fabric according to the present invention will be described in more details referring to the accompanying drawings.

According to the embodiments, increased stitches are formed on the knitting needles of both front and rear needle beds of a flat knitting machine that face each other and are displaced laterally by half the pitch from each other. One or both of the front and rear needle beds are movable to the left and to the right.

First Embodiment

Figures 1, 2, 3, 4, 5, 6:
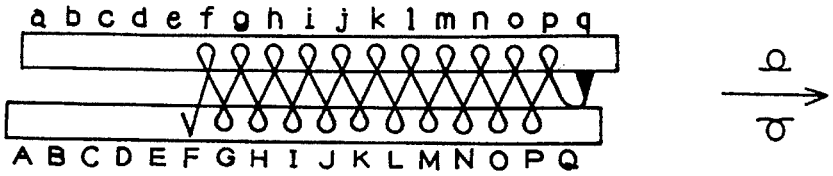
FIGS. 1-1 through 1-6 and FIGS. 2-1 through 2-4 illustrate a sequence of knitting courses according to a first embodiment of the present invention.
Figures 1, 2, 3, 4, 5:
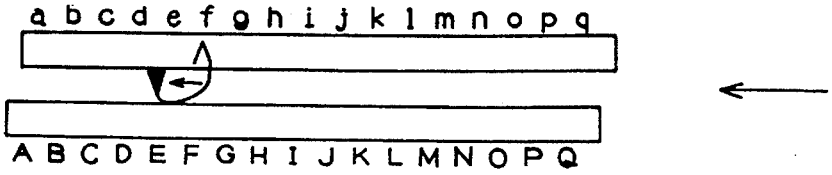
Figures 1, 2, 3, 4:
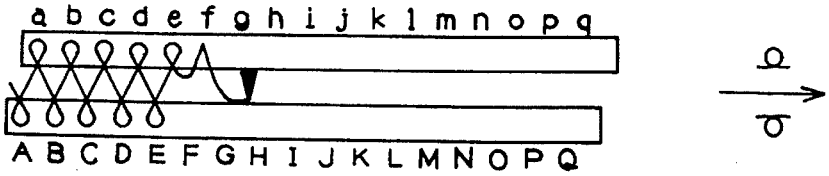
Figures 1, 2, 3:
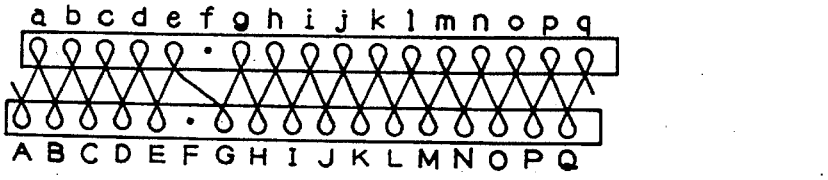
Figures 1, 2:
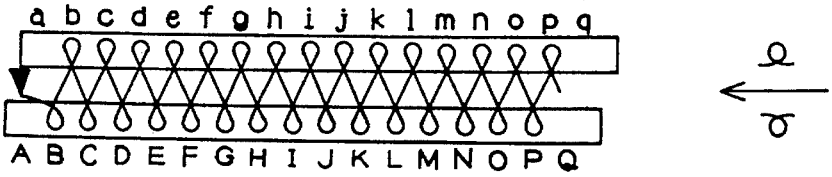
Figure 1:
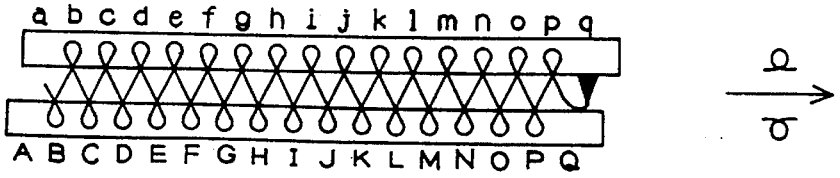
Figures 2, 3, 4:
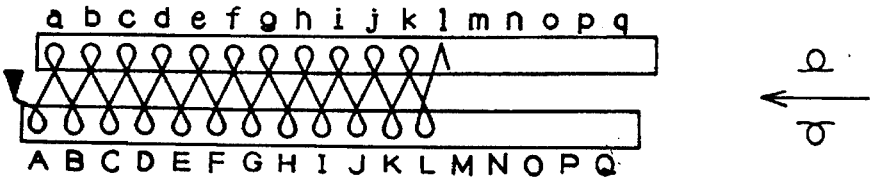
Figures 2, 3:
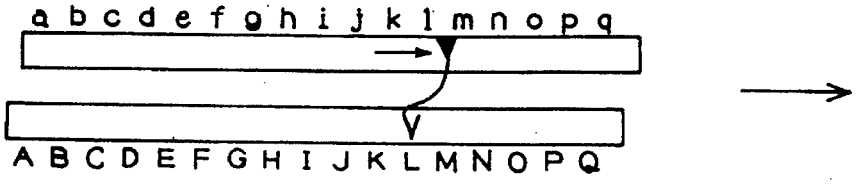
Figure 2:
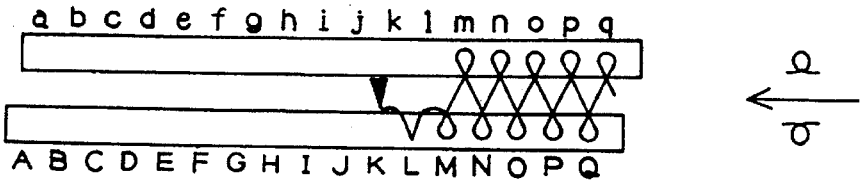
Figures 1, 2:
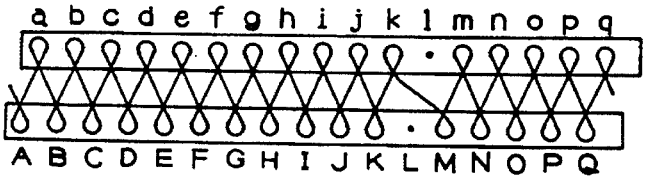
Figure 3:
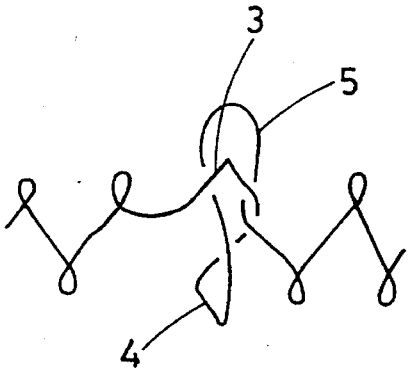
Figures 4, 5, 6:
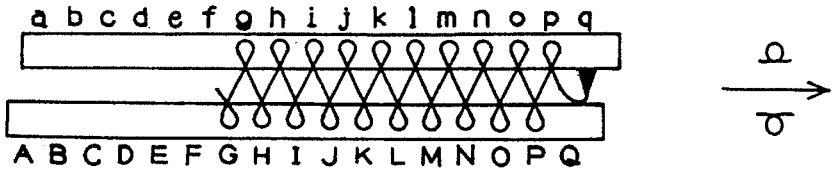
Figures 4, 5:
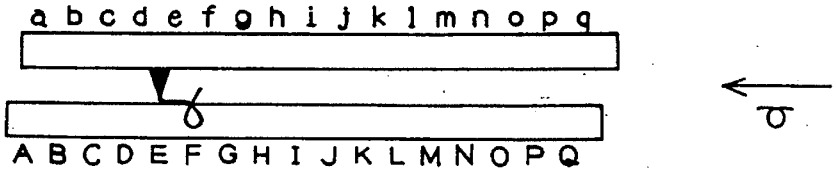
Figure 4:
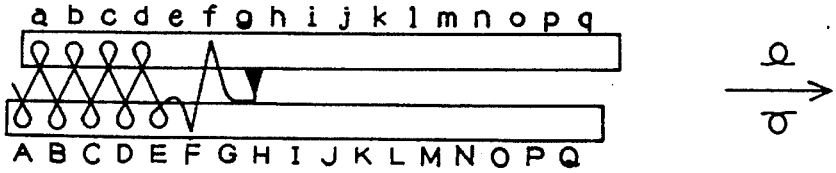
Figures 3, 4:
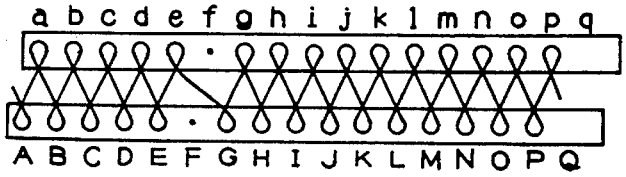
Figures 2, 4:
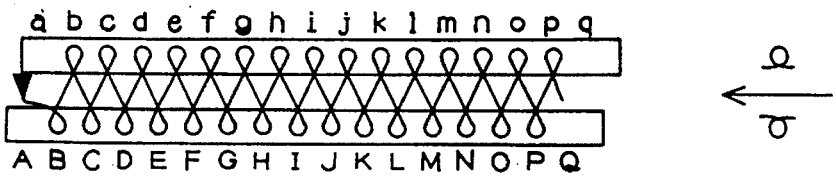
Figures 1, 4:
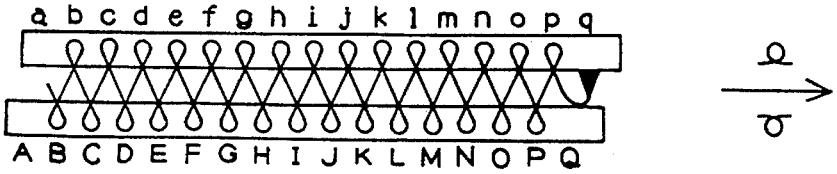
Figures 4, 5:
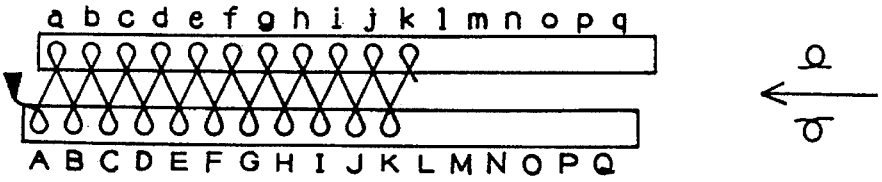
Figures 3, 5:
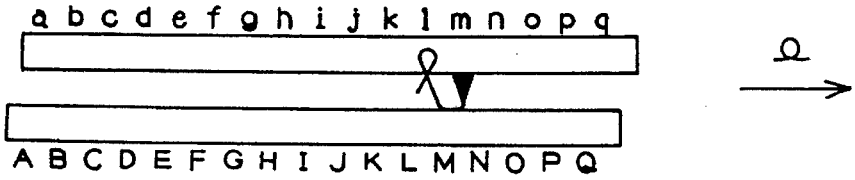
Figures 2, 5:
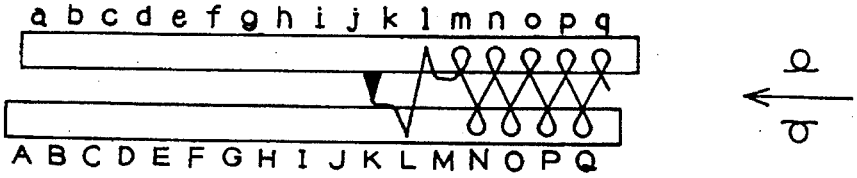
Figures 1, 5:
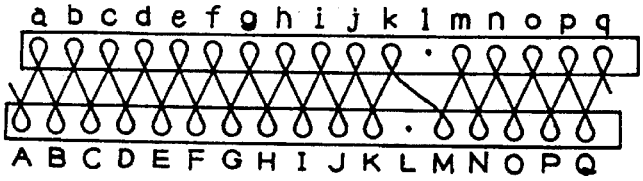
Figure 6:
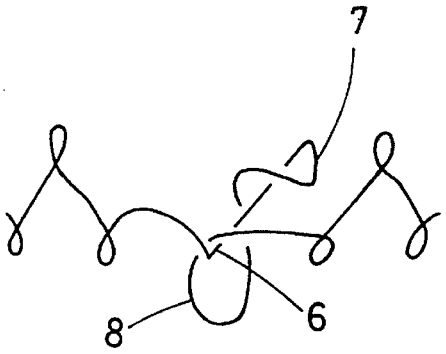

Rows of rib stitches are produced by repeating a desired number of times the course shown in FIGS. 1-1 and 1-2 with a thread of yarn being looped on the front bed needles B to P and the rear bed needles b to p alternately.

After repeating the courses shown in FIGS. 1-1 and 1-2, the loop on the knitting needle B at the side end of the knitted fabric is transferred to the unoccupied needle a next to the knitting needle b of the rear needle bed.

After the rear bed is racked in the direction of the unoccupied needle (to the left in the drawings), the loop on the needle a is transferred to the knitting needle A of the front needle bed. As the result, the loop of yarn is shifted from the knitting needle B to the needle A in the leftward direction.

By repeating this procedure with a series of racking actions, the loops on the knitting needles on the front and rear beds are shifted one by one to the left until the two target knitting needles F and f hold no loops of yarns, FIG. 1-3.

For producing increased knit stitches in the embodiment, after the thread of yarn is supplied to the front bed needles A to E and the rear bed needles a to e alternately for rib knitting, the thread of yarn is hooked on the knitting needle f on read bed needles next to the last needle e. After the action shown in FIG. 1-4, the carriage of the flat knitting machine is moved in a reverse direction to locate the feeder of yarn on the left of the knitting needle F of the front needle bed. As shown in FIG. 1-6, the thread of yarn is then hooked on the needle F and supplied to the needle f of the rear needle bed to form a knit stitch.

This is followed by supplying the thread to the knitting needles G to P of the front bed and the knitting needles g to p of the rear bed alternately for rib knitting.

As shown in FIG. 2-1, using the same manner as described above, the loops on the knitting needles L to P of the front bed and the knitting needles 1 to p of the rear bed are transferred one by one to their right side needles with a series of racking actions. As the result the two needles L and 1 are unoccupied. Then, the thread of yarn is supplied to the front bed needles Q to M and the rear bed needles q to m alternately for rib knitting and just hooked on the knitting needle L next to the last needle M, as shown in FIG. 2-2. The carriage is now moved in a reverse direction to locate the feeder of yarn on the right of the knitting needle 1 of the rear needle bed, as shown in FIG. 2-3. Next, as shown in FIG. 2-4, the thread of yarn is only hooked on the needle 1 and supplied to the knitting needles L to A of the front bed and the knitting needles k to a of the rear bed alternately for rib knitting. Accordingly, two knit stitches are added with two pairs of the knitting needles F and f and L and 1.

FIG. 3 illustrates a pattern of the thread between the front and rear knitting needles F and f after the course shown in FIG. 1-6 is completed. As apparent, the hooked thread or stitch 3 on the knitting needle f of the rear needle bed (cf. although the hooked thread is not looped on a knitting needle, it will be referred to as a hooked stitch hereinafter for ease of the description) is directly succeeding to a stitch on the adjacent knitting needle e. Hence, the length of the thread will be shorter as compared with a conventional method in which the thread is passed from the rear knitting needle e via the front knitting needle F to the rear needle f.

The thread extending from the hooked stitch 3 created on the knitting needle f in the course of FIG. 1-4 to the hooked stitch 4 produced on the knitting needle F in the course of FIG. 1-6 intersects the thread extending from the hooked stitch 4 to a knit stitch 5 on the knitting needle f of the rear bed. Also, the thread extending from the knit stitch 5 on the knitting needle f to the knitting needle G of the front bed intersects the thread extending from the hooked stitch 3 on the knitting needle f to a knit stitch 4 on the knitting needle F of the front bed. Accordingly, the hooked stitch 4 on the front knitting needle F and the knit stitch 5 on the rear knitting needle f both will not be pulled up by stitches produced on the knitting needles F and f in the succeeding course. Also, the stitches on the knitting needles e and G of their respective rear and front beds are drawn towards the stitches on the front F and rear knitting needles f respectively. There will be no loose yarn between stitches where the new stitches are added, as unlikely in conventional stitch increase methods.

The first embodiment resides in a case where increased stitches are formed inwardly from both sides at a set of knitting needles F and f and at another set of knitting needles L and 1. If stitches are made on the knitting needles F and f, but not on the knitting needles L and 1, the stitches increase. The course shown in FIG. 1-6 is followed by passing the yarn thread along the front knitting needles A to Q and the rear knitting needles a to q alternately for rib knitting.

According to the embodiment, the step shown in FIG. 1-3 is resulted from shifting the loops by one needle pitch to the left from the locations shown in FIG. 1-2. The procedure may be carried out on a four-bed flat knitting machine having two pairs of front and rear beds arranged one over the other by transferring the loops from the knitting needles B to F of a lower front bed to the corresponding knitting needles of an upper rear bed at once, racking the rear beds to the left by one needle pitch, and shifting the loops to the knitting needles A to E of the lower front bed.

Similarly, the loops on the knitting needles b to f of a lower rear bed may simultaneously be transferred to the corresponding needles of the upper front bed and after racking action, shifted to the knitting needles a to e of the lower rear bed. The four-bed flat knitting machine permits a number of the loops to be shifted at one time thus reducing the operating time considerably as compared with the two-bed flat knitting machine.

Additional stitches in the first embodiment are provided for increasing the number of wales to shape a knitted fabric or garment and increase its size. The present invention is also applicable for making increased stitches to fill a gap or hole in a knitted fabric that has been created by dislocating and overlapping some adjacent stitches to form a decorative pattern with the four-bed flat knitting machine. Those advantages are common to a second and a third embodiments of the present invention which will be described below.

Second Embodiment

The second embodiment is differentiated from the first embodiment by a sequence of steps starting from the course shown in FIG. 4-4. Therefore, we will explain the steps after FIG. 4-4 but not the procedures shown in FIGS. 4-1 to 4-3.

As shown in FIG. 4-4, a thread of yarn is supplied to the front knitting needles A to E and the rear knitting needles a to d alternately for rib knitting and hooked on the knitting needle f of the rear bed as well as the knitting needle F next to the needle E. The carriage is then moved in a reverse direction to allow the thread to loop on the knitting needle F for making a knit stitch, as shown in FIG. 4-5. The carriage is then turned to run in the forward direction as shown in FIG. 4-6 so that the thread is supplied to the front knitting needles G to P and the rear knitting needles g to p alternately for rib knitting.

Similarly, for making increased stitches on the front knitting needle L and the rear knitting needle 1, the loops on the front knitting needles L to P and the rear knitting needles 1 to p are shifted to their right-side neighbor needles by one-by-one transfer with a series of racking actions. As the result, the knitting needles L and 1 hold no thread, as shown in FIG. 5-1. The thread of yarn is then supplied to the rear knitting needles q to m and the front knitting needles Q to N alternately for rib knitting and just hooked on the rear knitting needle 1 next to the last needle m and also, the front knitting needle L for no stitch knitting, as shown in FIG. 5-2. Then, the carriage is moved in a reverse direction to allow the thread to form a stitch on the knitting needle 1, as shown in FIG. 5-3. The carriage is turned to run in the forward direction as shown in FIG. 5-4 so that the thread is supplied to the rear knitting needles k to a and the front knitting needles K to A alternately for rib knitting. Accordingly, the increased stitches are formed at two locations on a set of the knitting needles F and f and another set of the knitting needles L and 1.

FIG. 6 illustrates a pattern of the thread engaged with the front knitting needle F and the rear knitting needle f after the course shown in FIG. 4-6. As apparent, a hooked stitch 6 on the knitting needle F is directly succeeding to a knit stitch on the neighbor knitting needle E. Accordingly, the length of a thread between the two stitches will be shorter as compared with extending from the knitting needle E via the rear knitting needle e to the knitting needle F.

The thread extending from the hooked stitch 6 created on the knitting needle F in the course of FIG. 4-4 to a hooked stitch 7, FIG. 6, formed on the knitting needle f intersects the thread extending from the hooked stitch 7 to a knit stitch 8 produced on the knitting needle F in the course shown in FIG. 4-5. Also, the thread extending from the knit stitch 8 on the knitting needle F to the next knitting needle G of the front bed intersects the thread extending from the hooked stitch 6 on the knitting needle F to the knit stitch 7 on the knitting needle f of the rear bed.

Accordingly, the knit stitch 8 on the front knitting needle F and the hooked stitch 7 on the rear knitting needle f both will not be pulled up by stitches produced on the knitting needles F and f in the succeeding course. Also, the stitches on the knitting needles E and G of the front bed are drawn towards the stitches on the front F and rear knitting needles f respectively. There will be no loose nor gap between stitches where the new stitches are added, as being unlikely in the conventional stitch increase method.

Third Embodiment

Figures 6, 7:
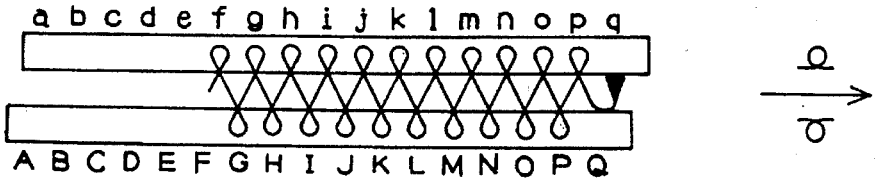
Figures 5, 7:
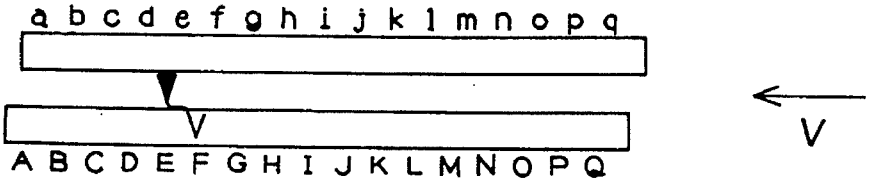
Figures 4, 7:
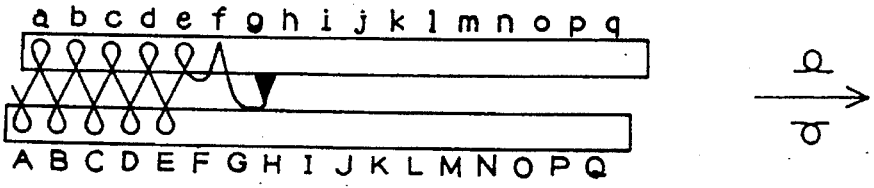
Figures 3, 7:
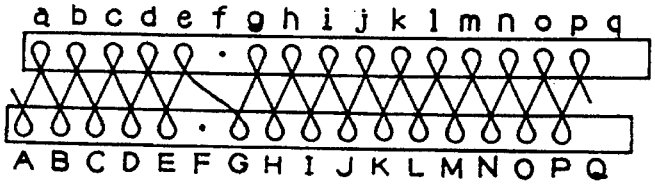
Figures 2, 7:
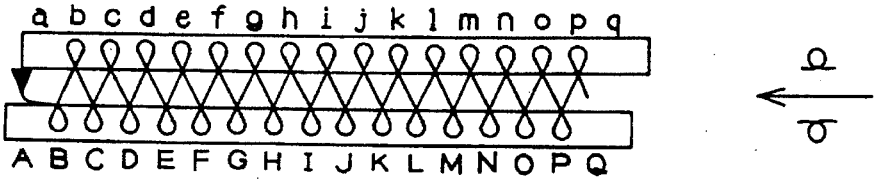
Figures 1, 7:
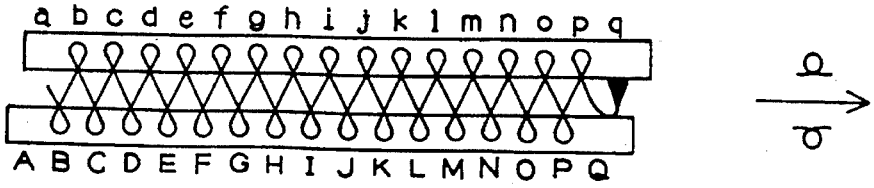

The third embodiment is distinguished from the first or second embodiment by a sequence of steps starting from the course shown in FIG. 7-4. Hence, we will explain the steps after FIG. 7-4 but not the procedures shown in FIGS. 7-1 to 7-3.

As shown in FIG. 7-4, a thread of yarn is supplied to the front knitting needles A to E and the rear knitting needles a to e alternately for rib knitting and particularly, hooked on the knitting needle f next to the last needle e of the rear bed. The carriage is then moved in a reverse direction to allow the thread to form a stitch on the knitting needle F, as shown in FIG. 7-5. The carriage is then turned to run in the forward direction and supplied the thread to the rear knitting needle f to form a loop, as shown in FIG. 7-6, before making rows of loops on the front knitting needles G to P and the rear knitting needles g to p alternately for rib knitting.

Figures 4, 8:
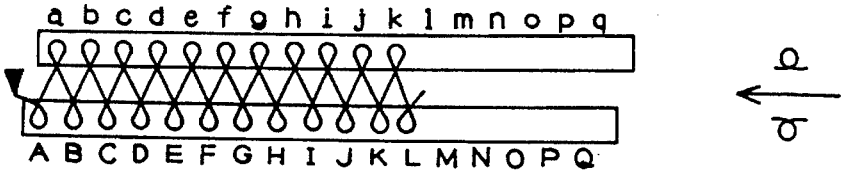
Figures 3, 8:
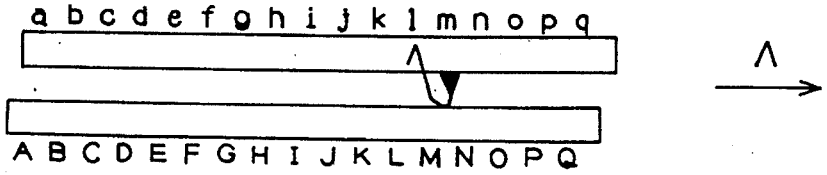
Figures 2, 8:
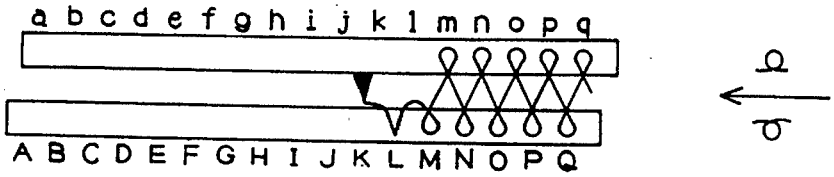
Figures 1, 8:
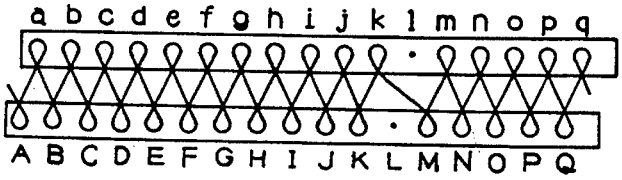

Similarly, for making increased stitches on the front knitting needle L and the rear knitting needle 1, the loops on the front knitting needles L to P and the rear knitting needles 1 to p are shifted to their right-side neighbor needles by one-by-one transfer with a series of racking actions. As the result, the knitting needles L and 1 hold no thread, as shown in FIG. 8-1. The thread of yarn is then supplied to the rear knitting needles q to m and the front knitting needles Q to M alternately for rib knitting and just hooked on the front knitting needle L next to the last needle M, as shown in FIG. 8-2. In the course shown in FIG. 8-3, the carriage is moved in a reverse direction and the thread is hooked on the unoccupied knitting needle 1. The carriage is then turned to run in the forward direction as shown in FIG. 8-4 so that the thread is supplied to the front knitting needle L to make a knit stitch before forming rows of loops on the rear knitting needles k to a and the front knitting needles K to A alternately for rib knitting.

Accordingly, the increased stitches are produced at two locations on a set of the knitting needles F and f and another set of the knitting needles L and 1.

Figure 9:
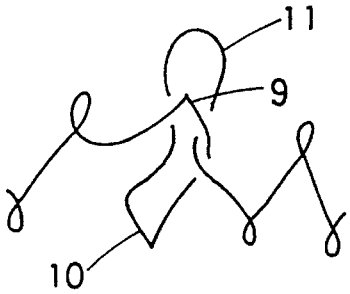
FIG. 9 is a schematic view showing a pattern of yarn of increased stitches of the third embodiment.
Figures 6, 10:
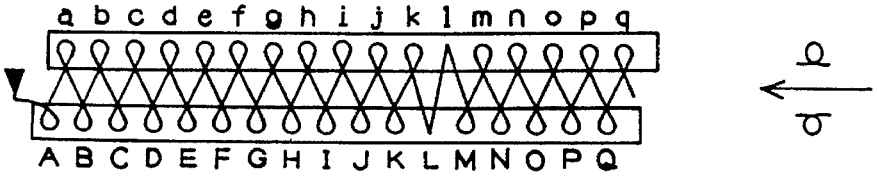
PRIOR ART Fig. 10-6
Figures 5, 10:
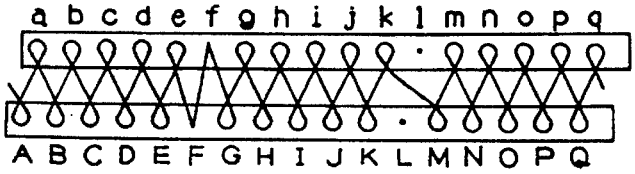
Figures 4, 10:
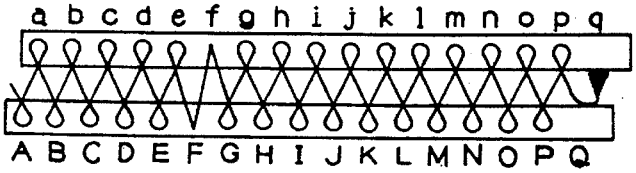
Figures 3, 10:
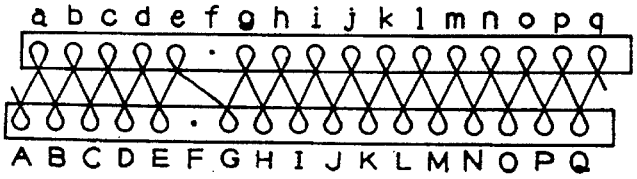
Figures 2, 10:
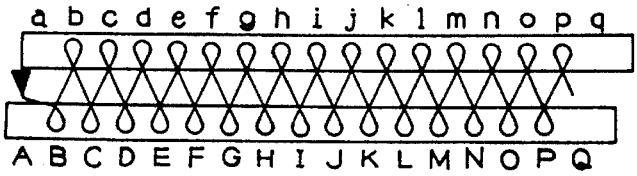
Figures 1, 10:
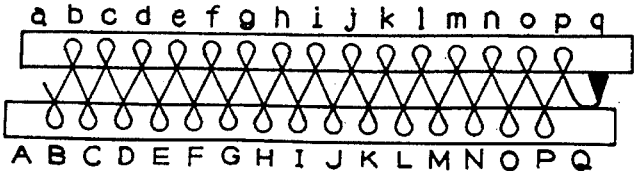
Figure 11:
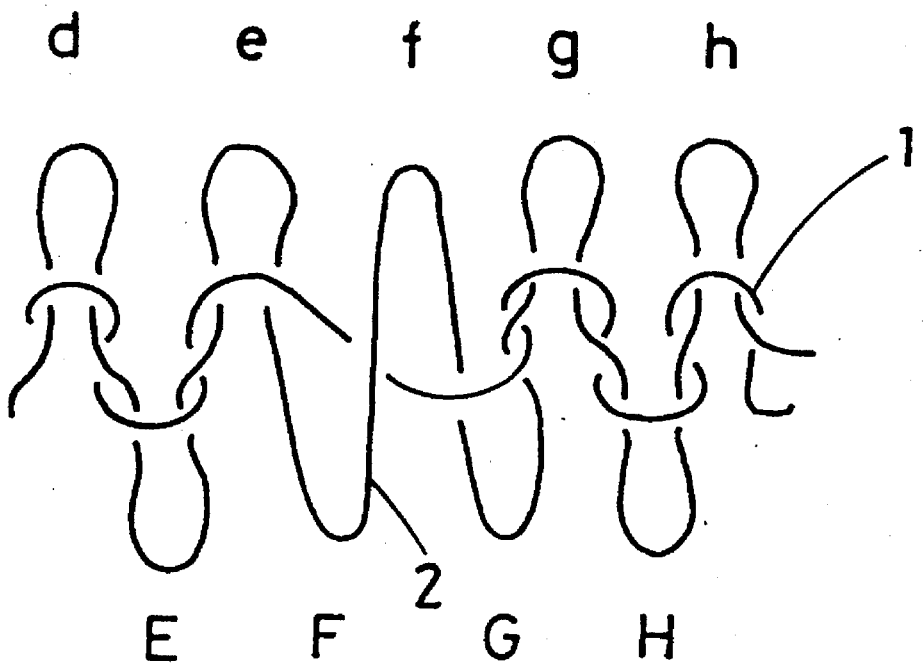
PRIOR ART Fig. 11
FIG. 11 is a schematic view showing a pattern of yarn of increased stitches after the course shown in FIG. 10-4.

FIG. 9 illustrates a pattern of the thread engaged with the front knitting needle F and the rear knitting needle f after the course shown in FIG. 7-6. As apparent, a hooked stitch 9 on the rear knitting needle f is directly linked with a knit stitch on the neighbor knitting needle e.

Accordingly, the length of a thread between the two stitches will be shorter as compared with extending from the knitting needle e via the front knitting needle F to the knitting needle f in the conventional method.

The thread extending from a hooked stitch 9 created in the course of FIG. 7-4 to a hooked stitch 10 formed in the course of FIG. 7-5 intersects the thread extending from a knit stitch 11 formed in the course of FIG. 7-6 to the knitting needle F of the front bed. Accordingly, the hooked stitch 10 on the front knitting needle F and the knit stitch 11 on the rear knitting needle f both will not be pulled up by stitches produced on the knitting needles F and f in the succeeding course. Also, the stitches on the knitting needles e and G of the rear and front beds, respectively, are drawn towards the stitches on the front F and rear knitting needles f, respectively. There will thus be generated no loose nor gap between stitches where the new stitches are added.

What is claimed is:

1. A method for increasing yarn stitches at intermediate positions in a row of stitches of a rib knit fabric knitted on a flat knitting machine having at least one pair of front and rear needle beds, at least one of the needle beds being movable to the left and to the right, a carriage for adjusting positions of knitting needles and a yarn feeder feeding yarns to knitting needles, said yarn feeder moving in association with said carriage along a longitudinal direction of the needle beds, comprising a step of making a set of two target knitting needles, one on the front needle bed and the other on the rear needle bed where increased yarn stitches are to be formed by shifting a predetermined number of knitted yarn loops from knitting needles, including the target needles, in either a leftward or a rightward direction, the method further comprising the steps of:

forming yarn stitches on knitting needles from one end of said at least one pair of front and rear needle beds to said target knitting needles:

hooking a thread of said yarn being knitted on first one of said target knitting needles located next to knitting needle to which said thread of said yarn has been knitted at the end of the preceding course:

hooking said thread of said yarn on the other of said target knitting needle; and moving one of said needle bed in a reverse direction and applying the thread of said yarn to said first one of said target knitting needles and forming said increased stitch;

wherein the yarn feeder changes its moving direction within said knitting area.

2. A method for increasing stitches at intermediate positions in a row of stitches of a rib knit fabric of claim 1, wherein steps for forming increased stitches comprise:

forming yarn stitches on knitting needles from one end of a knitting area of a knitted fabric to a knitting needle next to said target knitting needle located at the further side in the forward direction of the yarn feeder;

hooking a thread of yarn by said target knitting needle located next to said knitting needle to which the yarn stitch was knitted at the end of the preceding step;

moving said yarn feeder in a reverse direction for preparation of a succeeding step;

moving said yarn feeder in a forward direction and hooking said thread on said other target knitting needle; and forming a yarn stitch on said target knitting needle located at the further side on which said thread has been hooked.

3. A method for increasing stitches at intermediate positions in a row of stitches of a rib knit fabric of claim 1, wherein steps for forming increased stitches comprise:

forming yarn stitches on knitting needles from one end of a knitted area of a knitted fabric to a knitting needle next to said target knitting needle located at the nearer side in the forward direction of the yarn feeder;

hooking a thread of yarn by said target knitting needle located next to said knitting needle to which the yarn stitch was knitted at the end of the preceding step;

hooking said thread of said yarn by said target knitting needle located at the further side in the carriage forward direction of said yarn feeder;

moving said yarn feeder in a reverse direction and forming a yarn stitch on said target knitting needle located at the nearer side on which said thread has been hooked; and moving said yarn feeder in a forward direction and forming a yarn stitch on a knitting needle located next to the knitting needle to which the yarn stitch was formed at the end of the preceding step.

4. A method for increasing stitches at intermediate positions in a row of stitches of a rib knit fabric of claim 1, wherein steps for forming increased stitches comprise:

forming yarn stitches on knitting needle from one end of a knitting area of a knitted fabric to a knitting needle next to said target knitting needle located at the further side in the forward direction of the yarn feeder;

hooking a thread of yarn by said target knitting needle located next to said knitting needle to which the yarn stitch was knitted at the end of the preceding step;

moving said yarn feeder in a reverse direction and hooking said thread on the other of said unoccupied target knitting needles; and moving said yarn feeder in a forward direction and forming a knit stitch on said target knitting needle located at said further side on which said thread has been hooked.

5. A method for increasing stitches at intermediate positions in a row of stitches of a rib knit fabric as recited in claim 1, wherein said increased stitches are knitted at the left and right salvages of said knitted fabric and widen said knitted fabric.

6. A method for increasing stitches at intermediate positions in a row of stitches of a rib knit fabric as recited in claim 2, wherein said increased stitches are knitted at the left and right salvages of said knitted fabric and widen said knitted fabric.

7. A method for increasing stitches at intermediate positions in a row of stitches of a rib knit fabric as recited claim 3, wherein said increased stitches are knitted at the left and right salvages of said knitted fabric and widen said knitted fabric.

8. A method for increasing stitches at intermediate positions in a row of stitches of a rib knit fabric as recited in claim 4, wherein said increased stitches are knitted at the left and right salvages of said knitted fabric and widen the knitted fabric.

* * * * *